US010224632B2

(12) United States Patent
Tenno et al.

(10) Patent No.: US 10,224,632 B2
(45) Date of Patent: Mar. 5, 2019

(54) ANTENNA DEVICE AND ELECTRONIC APPARATUS

(71) Applicant: Murata Manufacturing Co., Ltd., Nagaokakyo-shi, Kyoto-fu (JP)

(72) Inventors: Nobuyuki Tenno, Nagaokakyo (JP); Naoto Ikeda, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 15/666,595

(22) Filed: Aug. 2, 2017

(65) Prior Publication Data

US 2017/0331190 A1 Nov. 16, 2017

Related U.S. Application Data

(63) Continuation of application No. PCT/JP2016/050612, filed on Jan. 12, 2016.

(30) Foreign Application Priority Data

Feb. 3, 2015 (JP) ..... 2015-018979

(51) Int. Cl.

| | |
|---|---|
| ***H01Q 21/00*** | (2006.01) |
| ***H01Q 7/00*** | (2006.01) |
| ***H01Q 1/24*** | (2006.01) |
| ***H01Q 1/36*** | (2006.01) |
| ***H01Q 1/38*** | (2006.01) |
| ***H01Q 7/06*** | (2006.01) |

(52) U.S. Cl.

CPC ..... *H01Q 7/00* (2013.01); *H01Q 1/24* (2013.01); *H01Q 1/243* (2013.01); *H01Q 1/36* (2013.01); *H01Q 1/38* (2013.01); *H01Q 7/06* (2013.01)

(58) Field of Classification Search

CPC .. H01Q 7/00; H01Q 7/06; H01Q 1/38; H01Q 1/36; H01Q 1/243; H01Q 1/24

USPC ..... 455/343.1, 230; 343/867

See application file for complete search history.

(56) References Cited

U.S. PATENT DOCUMENTS 8,750,949 B2 * 6/2014 Merz ..... H04B 1/38 343/702

2006/0281435 A1 * 12/2006 Shearer ..... G06K 19/0707 455/343.1

(Continued)

FOREIGN PATENT DOCUMENTS

EP 1 547 753 A1 6/2005

JP 2007-088363 A 4/2007

(Continued)

OTHER PUBLICATIONS

Official Communication issued in International Patent Application No. PCT/JP2016/050612, dated Apr. 5, 2016.

*Primary Examiner* — Jean B Jeanglaude

(74) *Attorney, Agent, or Firm* — Keating & Bennett, LLP

(57) ABSTRACT

An insulating substrate including a principal surface and coil antennas disposed on the substrate and each including a coil conductor. The coil conductor includes a winding axis in a direction parallel or substantially parallel to the principal surface of the substrate. An auxiliary loop conductor that is connected to the coil conductors of the coil antennas and generates a magnetic flux that is in phase with those of the coil antennas as seen from the direction of the winding axis of the coil conductor is provided in and on the substrate.

20 Claims, 15 Drawing Sheets

(56) References Cited

U.S. PATENT DOCUMENTS

| | | | | |
|---|---|---|---|---|
| 2013/0130636 | A1* | 5/2013 | Ungan ..... | H04W 52/0235<br>455/230 |
| 2014/0266949 | A1 | 9/2014 | Yokoyama | |

FOREIGN PATENT DOCUMENTS

| | | | |
|---|---|---|---|
| JP | 4218519 | B2 | 2/2009 |
| JP | 2010-192951 | A | 9/2010 |
| JP | 2011-077702 | A | 4/2011 |
| JP | 2012-116576 | A | 6/2012 |
| JP | 2014-207432 | A | 10/2014 |

* cited by examiner

ANTENNA DEVICE AND ELECTRONIC APPARATUS

CROSS REFERENCE TO RELATED APPLICATIONS

This application claims the benefit of priority to Japanese Patent Application No. 2015-018979 filed on Feb. 3, 2015 and is a Continuation application of PCT Application No. PCT/JP2016/050612 filed on Jan. 12, 2016. The entire contents of each application are hereby incorporated herein by reference.

BACKGROUND OF THE INVENTION

1. Field of the Invention

The present invention relates to an antenna device preferably for use in a near field radio communication system or the like, and an electronic apparatus including the antenna device.

2. Description of the Related Art

In an RFID of the HF band for NFC (Near Field Communication) mounted in a mobile terminal, a coil antenna which magnetically couples with a communication partner antenna is used.

In the case where such a coil antenna is disposed within an electronic apparatus, when the coil antenna is disposed adjacent to a ground conductor pattern or a metallic member on a board disposed within a housing of the electronic apparatus, magnetic field generation by the coil antenna is hindered by the ground conductor or metallic member, so that the communication distance significantly decreases.

For example, Japanese Patent No. 4218519 discloses a configuration in which, in the case of disposing a coil antenna on a metal surface, a metal body is disposed in advance below the coil antenna such that the resonant frequency of the coil antenna does not change.

In the antenna device disclosed in Japanese Patent No. 4218519, stability of the resonant frequency is ensured. However, since the metal surface is present near the coil antenna, a magnetic flux radiated from the coil antenna is still hindered by the metal surface, so that it is difficult to achieve a large communication distance.

SUMMARY OF THE INVENTION

Preferred embodiments of the present invention provide antenna devices in which magnetic field generation by a coil antenna is unlikely to be hindered even when a ground conductor pattern or a metallic member is disposed adjacent to the coil antenna, and electronic apparatuses including the antenna device.

An antenna device according to a preferred embodiment of the present invention includes an insulating substrate including a principal surface, and a coil antenna disposed on the substrate and having a coil conductor, wherein the coil conductor has a winding axis in a direction parallel or substantially parallel to the principal surface of the substrate, and an auxiliary loop conductor that is connected to the coil conductor and generates a magnetic flux that is in phase with that of the coil antenna as seen from a direction of the winding axis of the coil conductor is located in and on the substrate.

With the above configuration, hindrance to magnetic field generation due to influence of a ground conductor pattern or a metallic member adjacent to the coil antenna is significantly reduced or prevented.

Preferably, the coil antenna includes a plurality of coil antennas including a first coil antenna and a second coil antenna, each of the first coil antenna and the second coil antenna has a winding axis in the direction parallel or substantially parallel to the principal surface of the substrate, the winding axes of the first coil antenna and the second coil antenna are parallel or substantially parallel to each other, the first coil antenna and the second coil antenna are connected to each other so as to generate magnetic fields that are in phase with each other in the parallel or substantially parallel direction, and the auxiliary loop conductor is disposed in a range from the first coil antenna to the second coil antenna as seen from the direction of the winding axis of the coil conductor.

With the above configuration, in the case of including a plurality of coil antennas, hindrance to magnetic field generation due to a ground conductor pattern or a metallic member is significantly reduced or prevented.

Preferably, a surface of the substrate on which the coil antenna is disposed is a surface opposite to a surface facing a first conductive member, and the auxiliary loop conductor is disposed so as to extend between the coil antenna and the first conductive member as seen from the direction of the winding axis of the coil conductor. With this configuration, hindrance to magnetic field generation due to the first conductive member is effectively reduced or prevented.

A second conductive member is preferably provided on the substrate and in at least a portion of a region surrounded by the auxiliary loop conductor in a plan view of the substrate.

With the above configuration, when the substrate is seen in a plan view, since the second conductive member is disposed in the region where the auxiliary loop conductor is located, the second conductive member blocks a magnetic flux that tries to link to the auxiliary loop conductor in a direction opposite to a magnetic linkage direction of the coil antenna. Thus, even when the position of a communication partner antenna changes, the antenna characteristics are more unlikely to deteriorate. In addition, since the second conductive member is included, a magnetism collecting effect to the coil antenna or the auxiliary loop conductor or a radiation effect to the communication side antenna is achieved.

Preferably, the coil antenna includes a terminal electrode conducted to the coil conductor and extending from the coil conductor along the coil conductor as seen from the direction of the winding axis of the coil conductor, the substrate includes a pad electrode to which the terminal electrode is connected, and a wiring conductor extended from the pad electrode, and an extending direction from the coil conductor to the terminal electrode and an extending direction from the pad electrode to the wiring conductor are the same. Accordingly, the terminal electrode defines a portion of a coil, so that it is possible to use a smaller-sized coil antenna.

A connection position of the wiring conductor to the pad electrode is preferably spaced away from a first end that is a connection position of the terminal electrode to the coil conductor, in a direction to a second end of the terminal electrode as seen from the direction of the winding axis of the coil conductor. Accordingly, a portion or the entirety of the terminal electrode defines and functions as a portion of the coil conductor.

An electronic apparatus according to a preferred embodiment of the present invention includes an antenna device according to any of the above-described preferred embodiments of the present invention, and a power supply circuit connected to the coil conductor of the antenna device. With this configuration, an electronic apparatus in which a coil antenna is mounted on a board is provided.

According to various preferred embodiments of the present invention, hindrance to magnetic field generation due to a ground conductor pattern or a metallic member adjacent to the coil antenna is significantly reduced or prevented. Thus, even when the coil antenna is disposed in a state where the ground conductor pattern or the metallic member is adjacent thereto, a decrease in maximum communicable distance, etc. are significantly reduced or prevented, and an antenna device having stable characteristics and an electronic apparatus including the antenna device are obtained.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described with reference to specific examples with reference to the drawings. In each drawing, the same portions are designated by the same reference signs. In a second preferred embodiment and preferred embodiments subsequent to the second preferred embodiment, the description of common matters is omitted, and the differences will be mainly described. In particular, the same advantageous effects achieved by the same configuration are not mentioned one by one in each preferred embodiment.

First Preferred Embodiment

Figure 1:
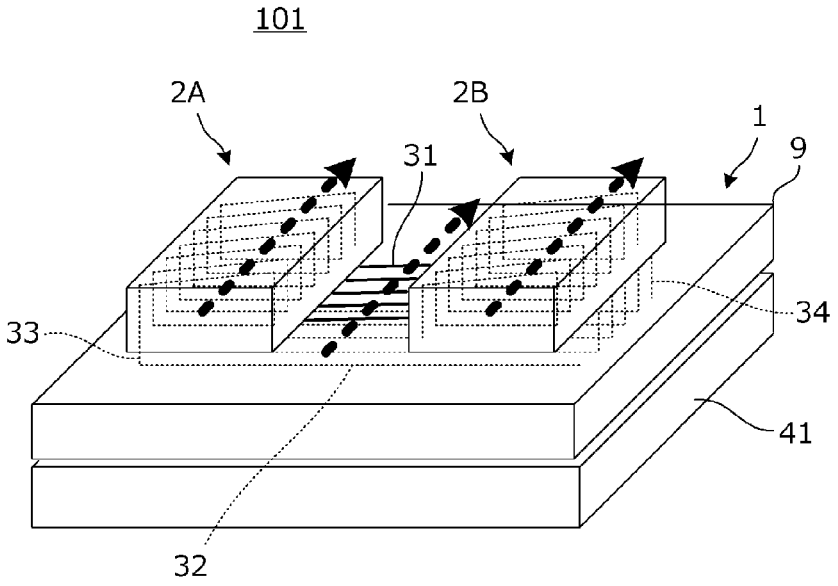
FIG. 1 is a perspective view of an antenna device 101 according to a first preferred embodiment of the present invention.
Figure 2:
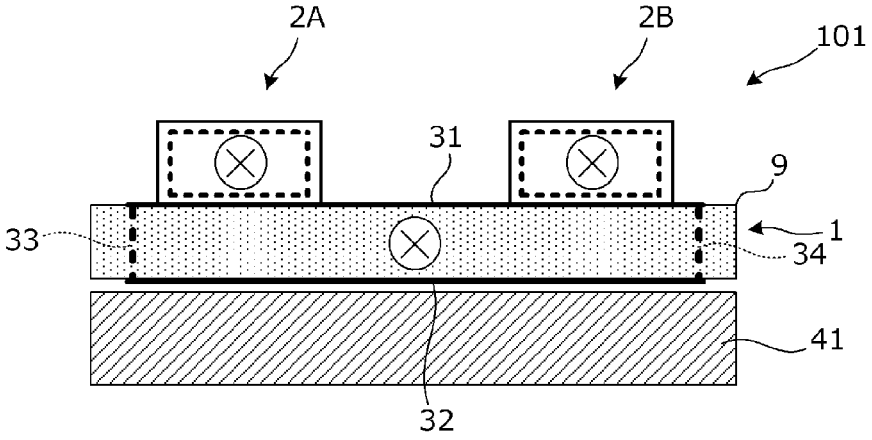
FIG. 2 is a cross-sectional view showing magnetic fluxes generated in the antenna device 101.

FIG. 1 is a perspective view of an antenna device 101 according to a first preferred embodiment of the present invention. FIG. 2 is a cross-sectional view showing a magnetic flux generated in the antenna device 101.

The antenna device 101 includes a board 1, a first coil antenna 2A, and a second coil antenna 2B. The antenna device 101 is mounted on a first conductive member 41.

As described later, each of the coil antennas 2A and 2B includes a coil conductor wound in a helical shape, and a mounting electrode conducted to the coil conductor.

The board 1 includes a substrate 9 and various conductor patterns provided on the substrate 9. An upper conductor pattern 31 is provided on the upper surface of the substrate 9, and a lower conductor pattern 32 is provided on the lower surface of the substrate 9. Interlayer connection conductors 33 and 34 are located within the substrate 9. The conductor patterns 31 and 32 and the interlayer connection conductors 33 and 34 define an auxiliary loop conductor. A RFIC that is not shown is connected to the auxiliary loop conductor.

Figure 3:
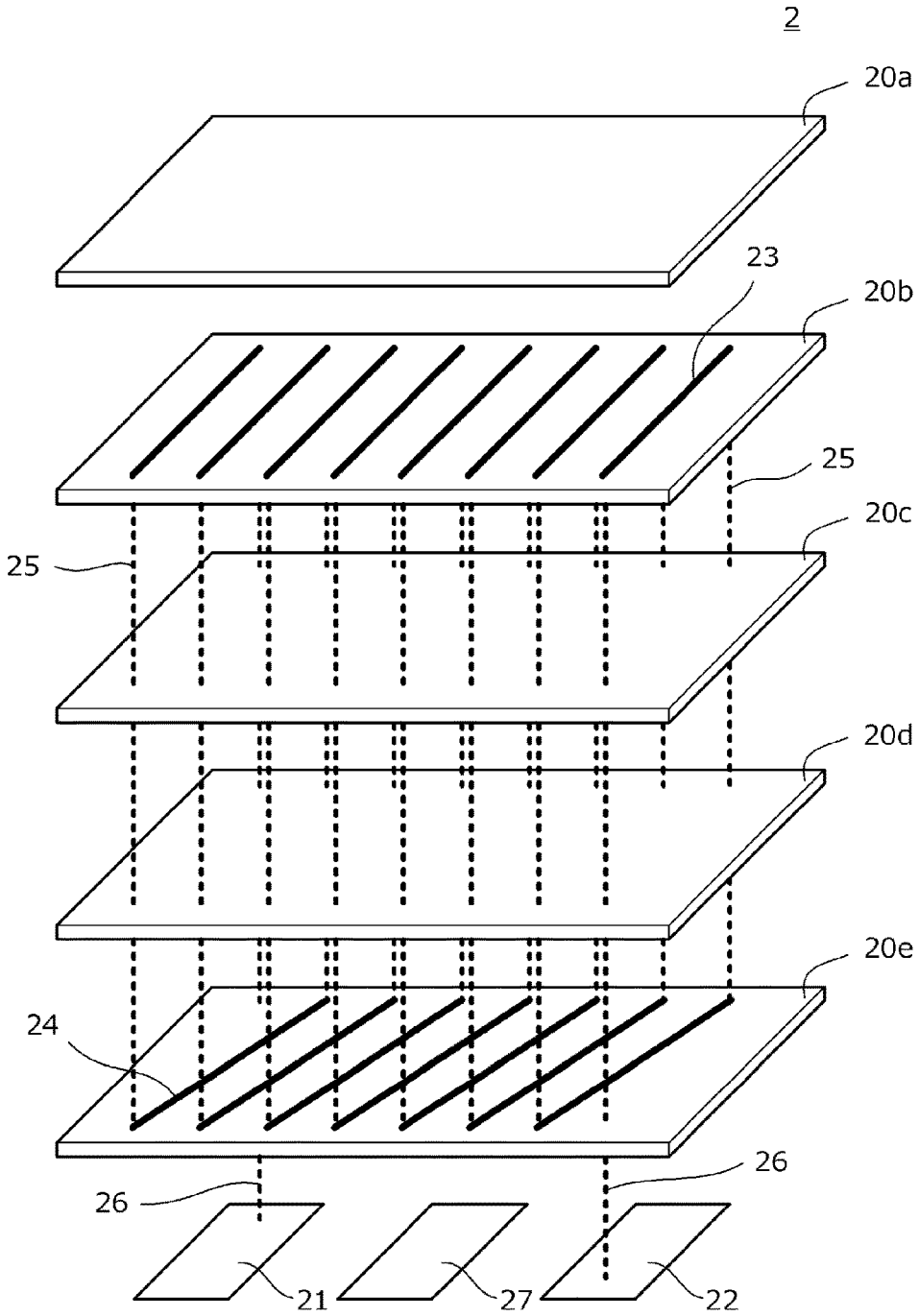
FIG. 3 is an exploded perspective view showing the internal configuration of a coil antenna 2.

FIG. 3 is an exploded perspective view showing the internal configuration of the coil antenna 2. The coil antenna 2 includes substrate layers 20*a*, 20*b*, 20*c*, 20*d*, and 20*e*, and conductor patterns provided on predetermined substrate layers among these substrate layers. The substrate layers 20*b*, 20*c*, and 20*d* are magnetic material layers, and the substrate layers 20*a* and 20*e* are nonmagnetic material layers. The magnetic material layers define and function as a magnetic material core of the coil antenna.

A plurality of coil conductors 23 are provided on the upper surface of the substrate layer 20*b*, and a plurality of coil conductors 24 are provided on the upper surface of the substrate layer 20*e*. Interlayer connection conductors (via conductors) 25 that interlayer-connect the coil conductors 23 and 24 are provided in the substrate layers 20*b*, 20*c*, and 20*d*. Mounting electrodes 21, 22, and 27 are provided on the lower surface of the substrate layer 20*e*. End portions of the coil conductors 23 at both ends in a direction where the plurality of coil conductors 23 are located are connected to the mounting electrodes 21 and 22 via interlayer connection conductors 26, respectively. In this manner, the coil antenna 2 is preferably a surface-mounted type component.

As represented in FIG. 2, the auxiliary loop conductor (31, 32, 33, 34) is disposed in a range from the first coil antenna 2A to the second coil antenna 2B as seen from the direction of a winding axis of the coil conductors.

The arrows shown in FIG. 1 and the cross signs shown in FIG. 2 represent the directions of magnetic fluxes generated by the coil antennas 2A and 2B and the auxiliary loop conductor (31, 32, 33, 34).

As described above, the coil conductors of each of the coil antennas 2A and 2B have a winding axis in a direction parallel or substantially parallel to a principal surface of the substrate 9. The auxiliary loop conductor is connected to the coil conductors of the coil antennas 2A and 2B, and generates a magnetic flux that is in phase with those of the coil antennas 2A and 2B as seen from the direction of the winding axis of the coil conductors of each of the coil antennas 2A and 2B.

A magnetic field generated in the auxiliary loop conductor (31, 32, 33, 34) is in phase with magnetic fields generated in the coil antennas 2A and 2B. Thus, among the magnetic fields generated in the coil antennas 2A and 2B, a magnetic flux that tries to extend around to the first conductive member 41 is forced to extend in a direction along the first conductive member 41. That is, operation in which magnetic field generation by the coil antennas 2A and 2B is hindered by the first conductive member is significantly reduced or prevented. Accordingly, it is possible to avoid a significant decrease in communication distance even when the first conductive member 41 is disposed at the back side of the board 1 of the antenna device 101.

In addition, the winding axis of the auxiliary loop conductor (31, 32, 33, 34) includes a component parallel or substantially parallel to the coil winding axes of the coil antennas 2A and 2B. Thus, even when the position of a communication partner antenna changes, the antenna characteristics are unlikely to deteriorate, since the magnetic flux links in the same direction as those of the coil antennas 2A and 2B.

Figure 4:
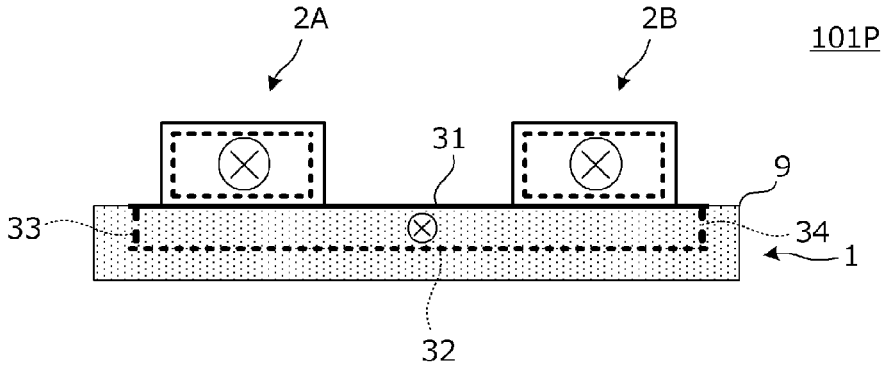
FIG. 4 is a cross-sectional view of another antenna device 101P according to the first preferred embodiment of the present invention.

FIG. 4 is a cross-sectional view of another antenna device 101P according to the first preferred embodiment. As is obvious in comparison with FIG. 2, the lower conductor pattern 32 is provided on an inner layer of the substrate 9. The other configuration is the same as in the antenna device 101 shown in FIG. 1 and FIG. 2. As described above, the auxiliary conductor does not have to be exposed outside the substrate 9.

Second Preferred Embodiment

Figure 5A:
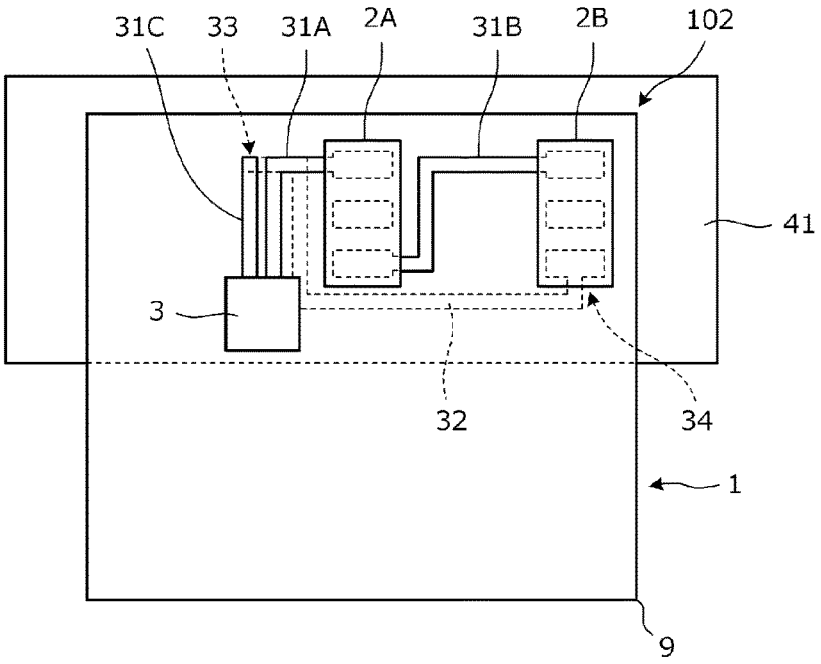
FIG. 5A is a plan view of an antenna device 102 according to a second preferred embodiment of the present invention.
Figure 5B:
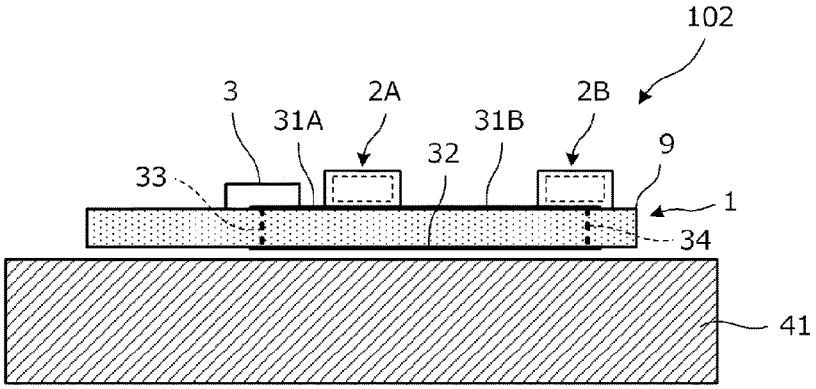
FIG. 5B is a cross-sectional view of the antenna device 102.

FIG. 5A is a plan view of an antenna device 102 according to a second preferred embodiment of the present invention, and FIG. 5B is a cross-sectional view of the antenna device 102.

The antenna device 102 includes a board 1, a first coil antenna 2A, a second coil antenna 2B, and a RFIC 3. The antenna device 102 is mounted on a first conductive member 41.

Upper conductor patterns 31A, 31B, and 31C are provided on the upper surface of a substrate 9, and a lower conductor pattern 32 is provided on the lower surface of the substrate 9. The upper conductor pattern 31C and a first end of the lower conductor pattern 32 are connected to each other via an interlayer connection conductor 33. A second end of the lower conductor pattern 32 and one connection portion of the coil antenna 2B are connected to each other via an interlayer connection conductor 34. The conductor patterns 31A, 31B, 31C, and 32 and the interlayer connection conductors 33 and 34 define an auxiliary loop conductor with about one turn.

The RFIC 3 and the coil antennas 2A and 2B are connected to each other via the following path. RFIC 3→upper conductor pattern 31A→coil antenna 2A→upper conductor pattern 31B→coil antenna 2B→interlayer connection conductor 34→lower conductor pattern 32→interlayer connection conductor 33→upper conductor pattern 31C→RFIC 3

The auxiliary loop conductor (31A, 31B, 31C, 32, 33, 34) is disposed in a range from the first coil antenna 2A to the second coil antenna 2B as seen from the direction of a winding axis of coil conductors of each of the coil antennas 2A and 2B. The winding axis of the auxiliary loop conductor includes a component parallel to the winding axes of the coil antenna 2A and the coil antenna 2B.

The coil conductors of each of the coil antennas 2A and 2B have a winding axis in a direction parallel or substantially parallel to a principal surface of the substrate 9. The auxiliary loop conductor generates a magnetic flux that is in phase with those of the coil antennas 2A and 2B as seen from the direction of the winding axis of the coil conductors of each of the coil antennas 2A and 2B.

A magnetic field generated in the auxiliary loop conductor (31A, 31B, 31C, 32, 33, 34) is in phase with magnetic fields generated in the coil antennas 2A and 2B. Thus, among the magnetic fields generated in the coil antennas 2A and 2B, a magnetic flux that tries to extend around to the first conductive member 41 is forced to extend in a direction along the first conductive member 41. That is, operation in which magnetic field generation by the coil antennas 2A and 2B is hindered by the first conductive member 41 is significantly reduced or prevented. Accordingly, it is possible to avoid a significant decrease in communication distance even when the first conductive member 41 is disposed at the back side of the board 1 of the antenna device 101.

Third Preferred Embodiment

Figure 6:
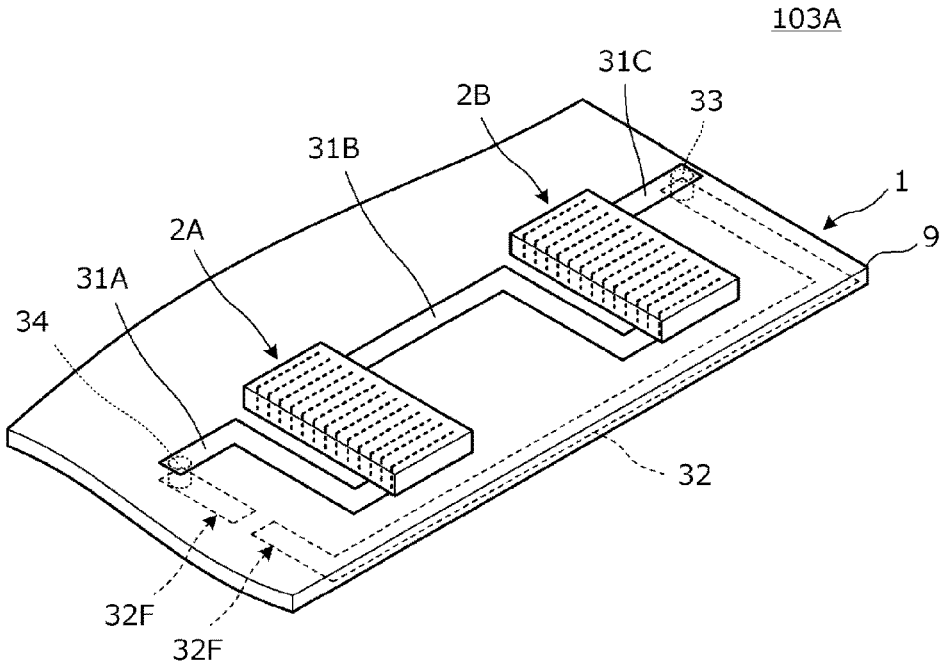
FIG. 6 is a perspective view of an antenna device 103A according to a third preferred embodiment of the present invention.
Figure 7C:
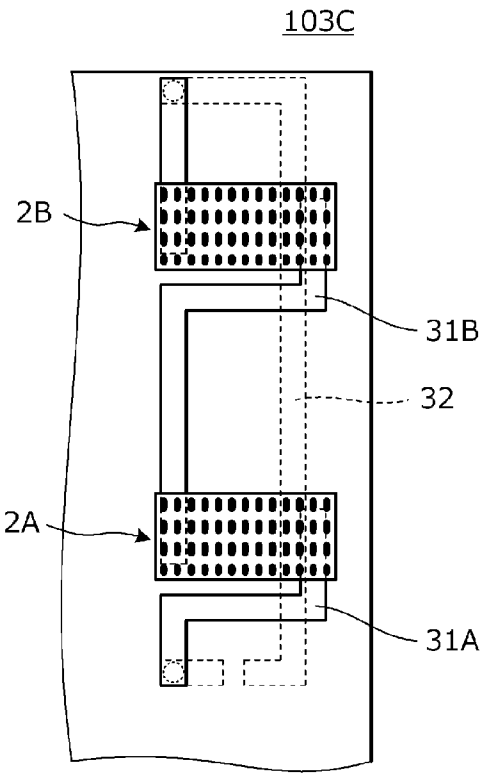
FIGS. 7B and 7C are plan views of antenna devices 103B and 103C of modifications of preferred embodiments of the present invention.
Figure 7B:
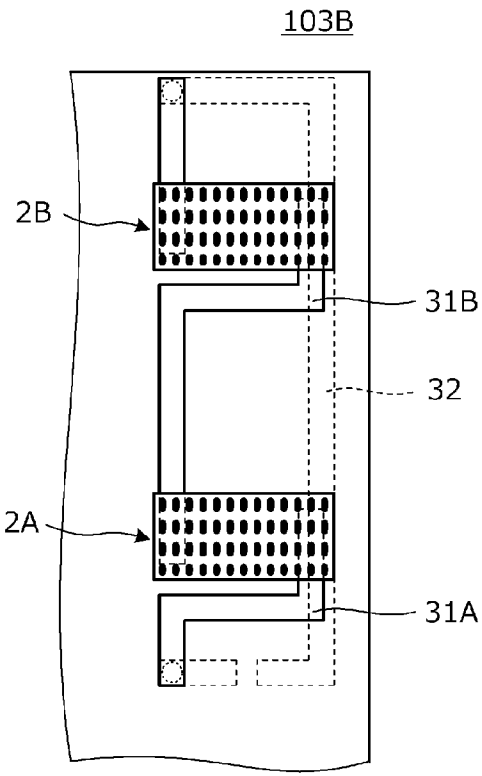
Figure 7A:
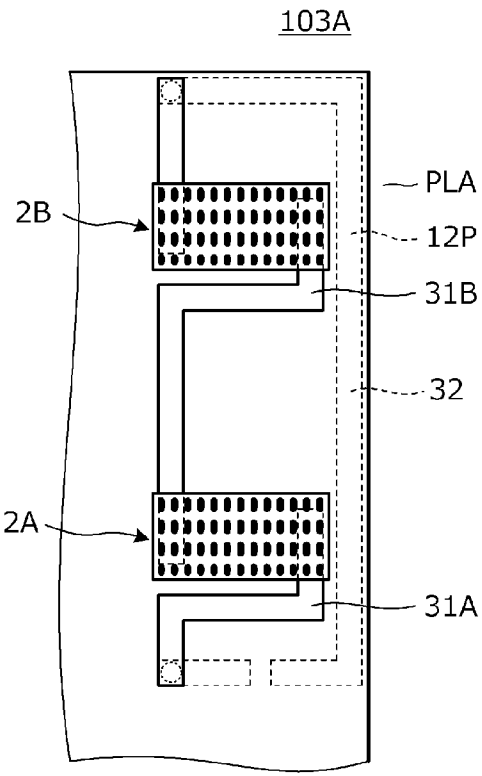
FIG. 7A is a plan view of the antenna device 103A.

FIG. 6 is a perspective view of an antenna device 103A according to a third preferred embodiment of the present invention. FIG. 7A is a plan view of the antenna device 103A. FIGS. 7B and 7C are plan views of antenna devices 103B and 103C of modifications of preferred embodiments of the present invention.

The antenna device 103A includes a board 1, coil antennas 2A and 2B, and a RFIC. Each of the coil antennas 2A and 2B includes coil conductors wound in a helical shape, and mounting electrodes. The coil antennas 2A and 2B are the same as the coil antenna 2 shown in the first preferred embodiment.

Upper conductor patterns 31A, 31B, and 31C are provided on the upper surface of a substrate 9, and a lower conductor pattern 32 is provided on the lower surface of the substrate 9. The upper conductor pattern 31C and a first end of the lower conductor pattern 32 are connected to each other via an interlayer connection conductor 33. A second end of the lower conductor pattern 32 and a first end portion of the upper conductor pattern 31A are connected to each other via an interlayer connection conductor 34. The conductor patterns 31A, 31B, 31C, and 32 and the interlayer connection conductors 33 and 34 define an auxiliary loop conductor with about one turn. RFIC connection portions 32F are provided in the middle of the lower conductor pattern 32. The RFIC is connected to (mounted on) the RFIC connection portions 32F.

The auxiliary loop conductor (31A, 31B, 31C, 32, 33, 34) is disposed in a range from the first coil antenna 2A to the second coil antenna 2B as seen from the direction of a winding axis of the coil conductors of each of the coil antennas 2A and 2B. The winding axis of the auxiliary loop conductor includes a component parallel or substantially parallel to the winding axes of the coil antenna 2A and the coil antenna 2B.

The coil conductors of each of the coil antennas 2A and 2B have a winding axis in a direction parallel or substantially parallel to a principal surface of the substrate 9. The auxiliary loop conductor generates a magnetic flux that is in phase with those of the coil antennas 2A and 2B as seen from the direction of the winding axis of the coil conductors of each of the coil antennas 2A and 2B.

A magnetic field generated in the auxiliary loop conductor (31A, 31B, 31C, 32, 33, 34) is in phase with magnetic fields generated in the coil antennas 2A and 2B.

As shown in FIG. 7A, in the antenna device 103A, the upper conductor patterns 31A and 31B do not overlap the lower conductor pattern 32 in a plan view. As shown in FIG. 7B, in the antenna device 103B, the upper conductor patterns 31A and 31B overlap the lower conductor pattern 32 in a plan view. In addition, as shown in FIG. 7C, in the antenna device 103C, the upper conductor patterns 31A and 31B overlap the lower conductor pattern 32 in a plan view.

As described above, depending on the manner in which the upper conductor patterns 31A and 31B and the lower conductor pattern 32 overlap in a plan view, the coil opening surface of the auxiliary loop conductor (31A, 31B, 31C, 32, 33, 34) is tilted, so that it is possible to determine the directivity of the generated magnetic flux. Accordingly, it is possible to control a magnetic flux that tries to extend around to the first conductive member 41, among the magnetic fields generated in the coil antennas 2A and 2B, to some extent.

Figure 8A:
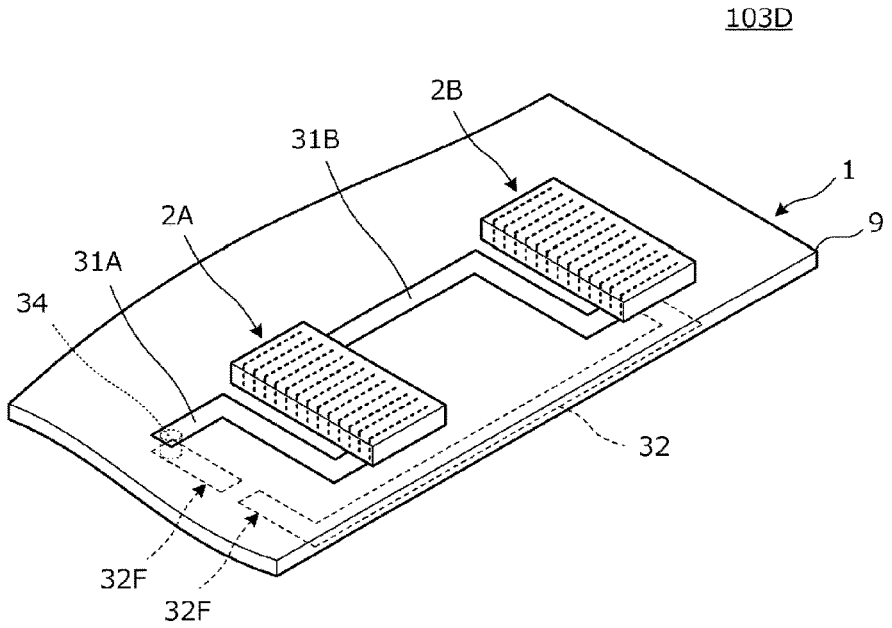
FIG. 8A is a perspective view of an antenna device 103D.
Figure 8B:
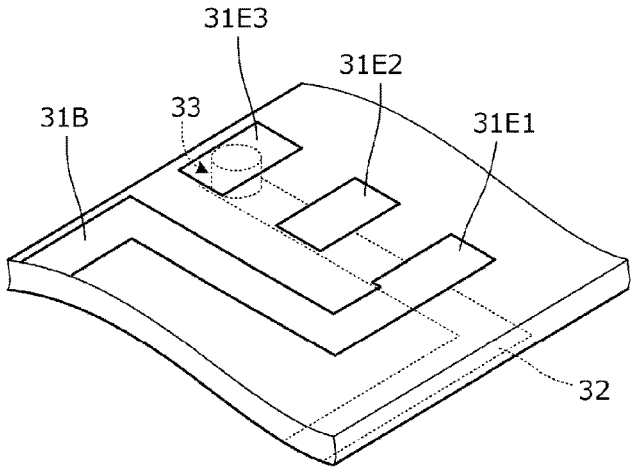
FIG. 8B is a perspective view of a portion of the antenna device 103D in which a coil antenna 2B is mounted.

FIG. 8A is a perspective view of an antenna device 103D. FIG. 8B is a perspective view of a portion of the antenna device 103D in which a coil antenna 2B is mounted.

The antenna device 103D includes a board 1, coil antennas 2A and 2B, and a RFIC. Each of the coil antennas 2A and 2B includes coil conductors wound in a helical shape, and mounting electrodes. The coil antennas 2A and 2B are the same as the coil antenna 2 shown in the first preferred embodiment.

Upper conductor patterns 31A and 31B and coil antenna connection portions 31E1, 31E2, and 31E3 are provided on the upper surface of a substrate 9, and a lower conductor pattern 32 is provided on the lower surface of the substrate 9. A first end of the lower conductor pattern 32 and a first end portion of the upper conductor pattern 31A are connected to each other via an interlayer connection conductor 34. A second end of the lower conductor pattern 32 and the coil antenna connection portion 31E1 are connected to each other via an interlayer connection conductor 34. A first end of the upper conductor pattern 31B is connected to the coil antenna connection portion 31E1. These conductor patterns define an auxiliary loop conductor with about one turn. RFIC connection portions 32F are provided in the middle of the lower conductor pattern 32. The RFIC is connected to (mounted on) the RFIC connection portions 32F. The winding axis of the auxiliary loop conductor includes a component parallel or substantially parallel to the winding axes of the coil antenna 2A and the coil antenna 2B.

As described above, the auxiliary loop conductor (31A, 31B, 31E1, 31E2, 31E3, 32, 33, 34) may be disposed in a range from the first coil antenna 2A to a portion of the second coil antenna 2B as seen from the direction of the winding axis of the coil conductors of each of the coil antennas 2A and 2B.

In the examples shown in FIGS. 6, 7A to 7C, and 8A, the configuration is shown in which the RFIC is connected to the RFIC connection portions 32F. However, in the case where either one of the coil antennas 2A and 2B includes a RFIC (power supply circuit), it is not necessary to mount an individual RFIC. In this case, the RFIC connection portions 32F only need to be a continuously conducted pattern.

Fourth Preferred Embodiment

Figure 9A:
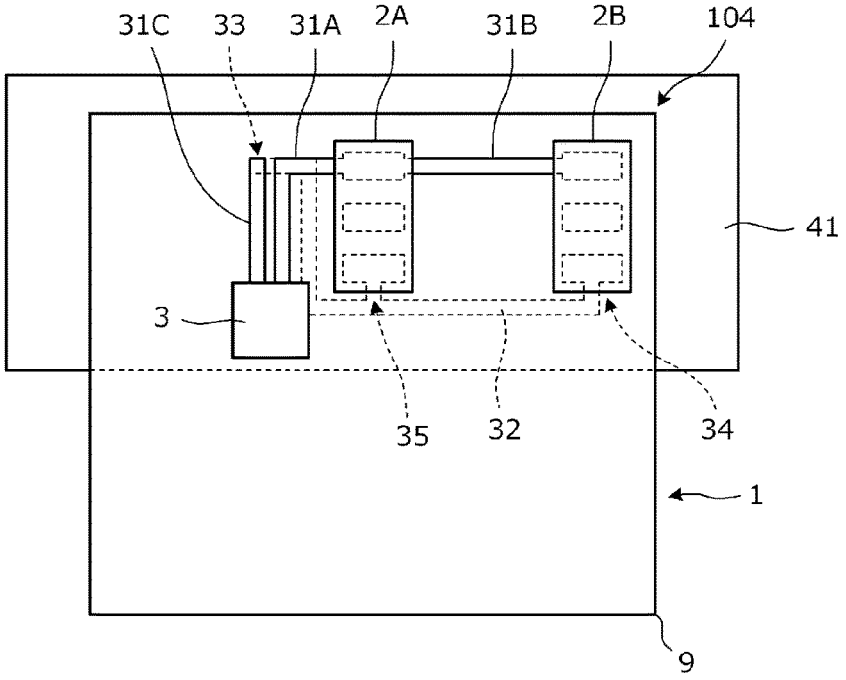
FIG. 9A is a plan view of an antenna device 104 according to a fourth preferred embodiment of the present invention.
Figure 9B:
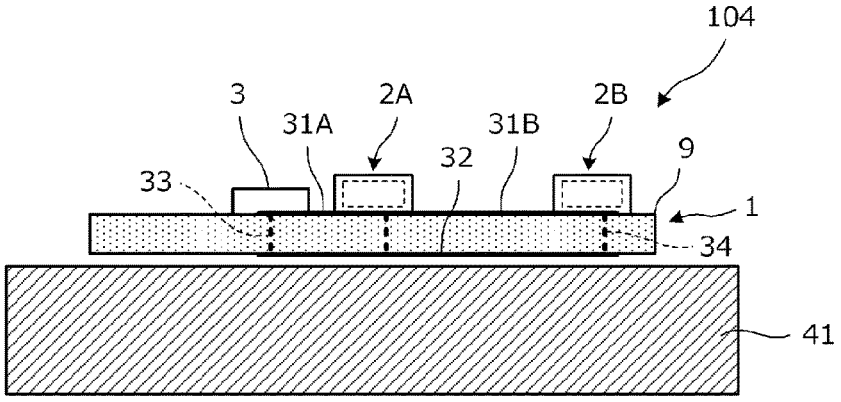
FIG. 9B is a cross-sectional view of the antenna device 104.

FIG. 9A is a plan view of an antenna device 104 according to a fourth preferred embodiment of the present invention, and FIG. 9B is a cross-sectional view of the antenna device 104.

The antenna device 104 includes a board 1, a first coil antenna 2A, a second coil antenna 2B, and a RFIC 3. The antenna device 104 is mounted on a first conductive member 41.

Upper conductor patterns 31A, 31B, and 31C are provided on the upper surface of a substrate 9, and a lower conductor pattern 32 is provided on the lower surface of the substrate 9. The upper conductor pattern 31C and a first end of the lower conductor pattern 32 are connected to each other via an interlayer connection conductor 33. A second end of the lower conductor pattern 32 and one connection portion of the coil antenna 2B are connected to each other via an interlayer connection conductor 34. The middle of the lower conductor pattern 32 and one connection portion of the coil antenna 2A are connected to each other via an interlayer connection conductor 35. The conductor patterns 31A, 31B, 31C, and 32 and the interlayer connection conductors 33 and 34 define an auxiliary loop conductor. The winding axis of the auxiliary loop conductor includes a component parallel or substantially parallel to the winding axes of the coil antenna 2A and the coil antenna 2B.

The two coil antennas 2A and 2B are connected in parallel to the upper conductor patterns 31A, 31B, and 31C and the lower conductor pattern 32. The auxiliary loop conductor (31A, 31B, 31C, 32, 33, 34) generates a magnetic flux that is in phase with those of the coil antennas 2A and 2B as seen from the direction of the winding axis of the coil conductors of each of the coil antennas 2A and 2B.

As in the present preferred embodiment, a plurality of coil antennas may be connected in parallel.

Fifth Preferred Embodiment

Figure 10A:
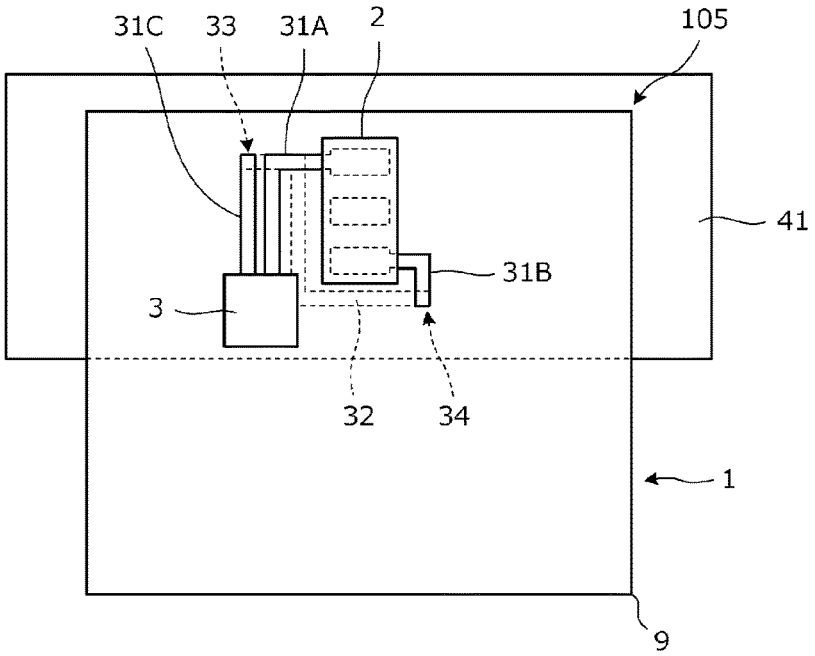
FIG. 10A is a plan view of an antenna device 105 according to a fifth preferred embodiment of the present invention.
Figure 10B:
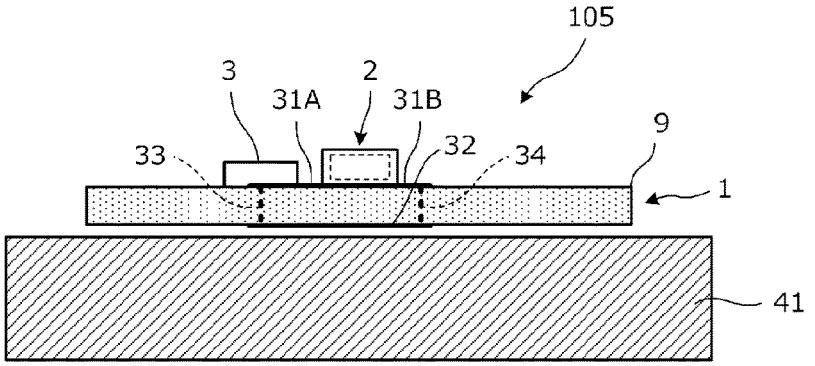
FIG. 10B is a cross-sectional view of the antenna device 105.

FIG. 10A is a plan view of an antenna device 105 according to a fifth preferred embodiment of the present invention, and FIG. 10B is a cross-sectional view of the antenna device 105.

The antenna device 105 includes a board 1, a coil antenna 2, and a RFIC 3. The antenna device 105 is mounted on a first conductive member 41.

Unlike the antenna device 102 shown in FIG. 5 in the second preferred embodiment, the antenna device 105 of the present preferred embodiment includes the single coil antenna 2. The other configuration is as shown in the second preferred embodiment.

The auxiliary loop conductor (31A, 31B, 31C, 32, 33, 34) generates a magnetic flux that is in phase with that of the coil antenna 2 as seen from the direction of the winding axis of the coil conductors of the coil antenna 2. As described above, the antenna device may include a single coil antenna.

Sixth Preferred Embodiment

Figure 11:
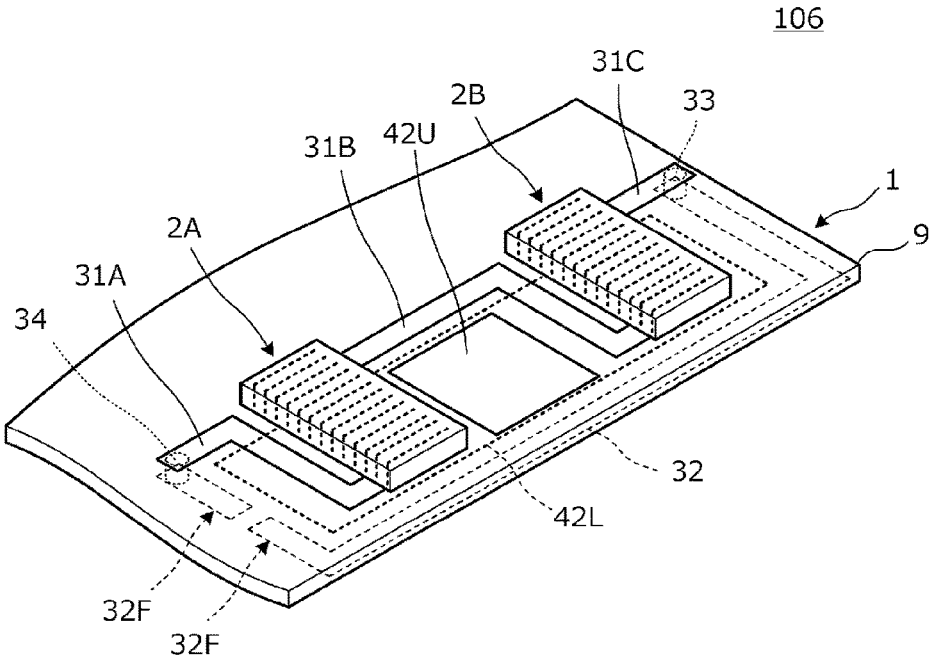
FIG. 11 is a perspective view of an antenna device 106 according to a sixth preferred embodiment of the present invention.
Figure 12:
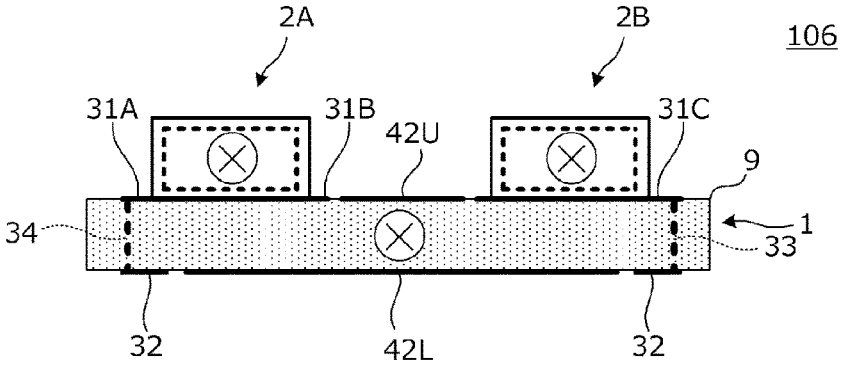
FIG. 12 is a cross-sectional view of the antenna device 106.

FIG. 11 is a perspective view of an antenna device 106 according to a sixth preferred embodiment of the present invention. FIG. 12 is a cross-sectional view of the antenna device 106.

Upper conductor patterns 31A, 31B, and 31C are provided on the upper surface of a substrate 9, and a lower conductor pattern 32 is provided on the lower surface of the substrate 9. The upper conductor pattern 31C and a first end of the lower conductor pattern 32 are connected to each other via an interlayer connection conductor 33. A second end of the lower conductor pattern 32 and a first end portion of the upper conductor pattern 31A are connected to each other via an interlayer connection conductor 34. The conductor patterns 31A, 31B, 31C, and 32 and the interlayer connection conductors 33 and 34 define an auxiliary loop conductor with about one turn. RFIC connection portions 32F are provided in the middle of the lower conductor pattern 32. The RFIC is connected to (mounted on) the RFIC connection portions 32F. The winding axis of the auxiliary loop conductor includes a component parallel or substantially parallel to the winding axes of the coil antenna 2A and the coil antenna 2B.

Second conductive members 42U and 42L are provided in a region surrounded by the auxiliary loop conductor (31A, 31B, 31C, 32, 33, 34) in a plan view of the substrate 9. The configuration other than the second conductive members 42U and 42L is the same as in the antenna device 103A shown in FIG. 6 in the third preferred embodiment.

The second conductive member 42U is provided between the first coil antenna 2A and the second coil antenna 2B on the upper surface (in a plan view) of the substrate 9. In addition, the second conductive member 42L is provided on the lower surface (in a plan view) of the substrate 9 and in a region where the lower conductor pattern 32 is provided.

Since the second conductive members 42U and 42L are disposed within the region where the auxiliary loop conductor (31A, 31B, 31C, 32, 33, 34) is provided in a plan view, the second conductive members 42U and 42L block a magnetic flux that tries to link to the auxiliary loop conductor in a direction opposite to a magnetic flux linkage direction of the coil antennas 2A and 2B. Thus, even when the relative position of the antenna device 106 relative to a communication partner antenna changes, the antenna characteristics are more unlikely to deteriorate.

Figure 13A:
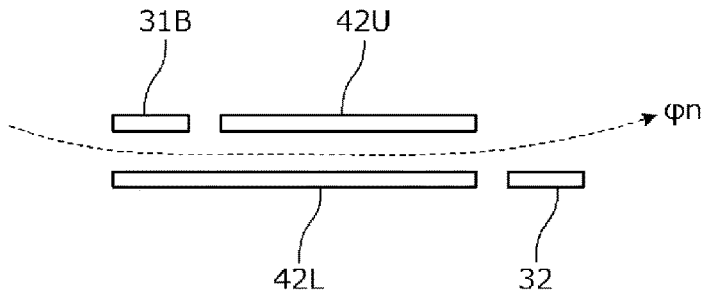
FIGS. 13A and 13B are diagrams showing operation of second conductive members 42U and 42L.
Figure 13B:
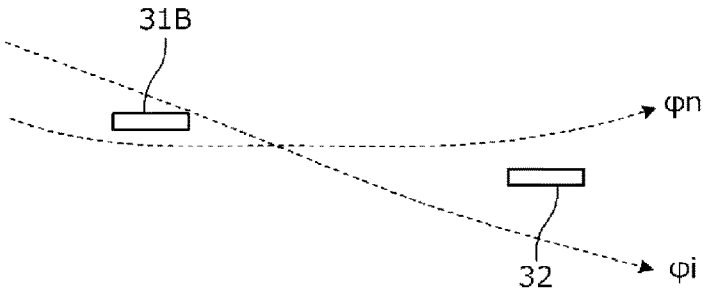

FIGS. 13A and 13B are diagrams showing operation of the second conductive members 42U and 42L. In a state where the second conductive members 42U and 42L are not present, as shown in FIG. 13B, in addition to a magnetic flux $\varphi n$ that normally links to the auxiliary loop conductor which includes the upper conductor pattern 31B and the lower conductor pattern 32, a magnetic flux $\varphi i$ that links thereto in the opposite direction is generated. On the other hand, when the second conductive members 42U and 42L are provided, as shown in FIG. 13A, a magnetic flux is inhibited from linking to the auxiliary loop conductor, which includes the upper conductor pattern 31B and the lower conductor pattern 32, in the opposite direction. Therefore, the intended effect of the auxiliary loop conductor is easily achieved.

Seventh Preferred Embodiment

A seventh preferred embodiment of the present invention shows an antenna device including a conductor pattern provided on a substrate on which a coil antenna is mounted.

Figure 14A:
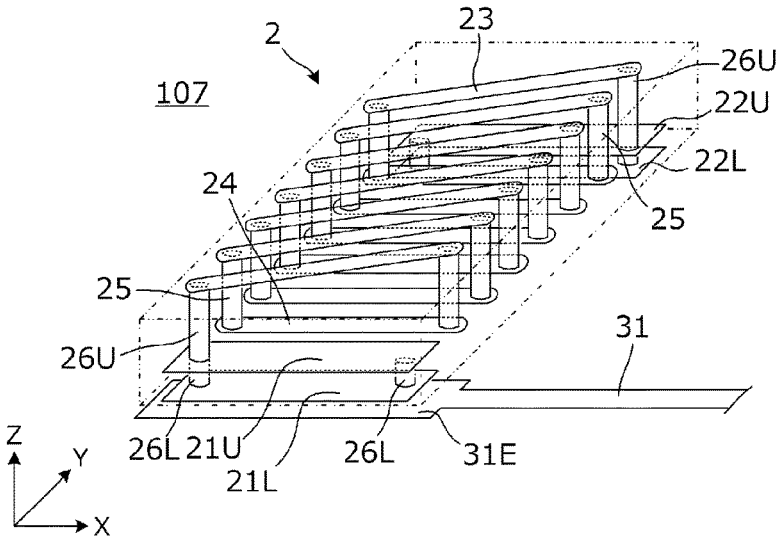
FIG. 14A is a perspective view of a main portion of an antenna device 107 according to a seventh preferred embodiment of the present invention.
Figure 14B:
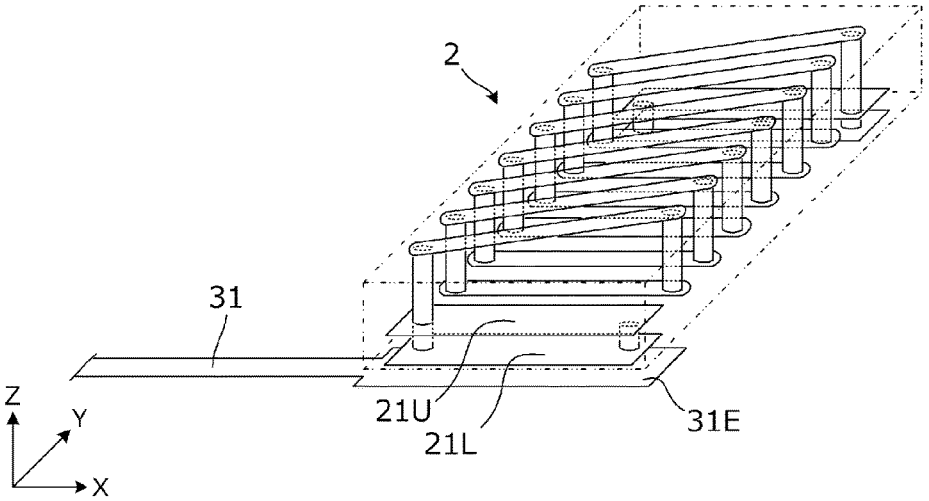
FIG. 14B is a perspective view of a main portion of an antenna device as a comparative example.

FIG. 14A is a perspective view of a main portion of an antenna device 107 according to the present preferred embodiment. FIG. 14B is a perspective view of a main portion of an antenna device as a comparative example. In FIGS. 14A and 14B, regarding a coil antenna 2, only a conductor portion is shown. In addition, also regarding a board, a portion of a conductor pattern provided on the upper surface thereof is shown.

The coil antenna 2 includes a plurality of substrate layers and a conductor pattern provided on a predetermined substrate layer among these substrate layers. A plurality of coil conductors 23 and 24 and interlayer connection conductors (via conductors) 25 that interlayer-connect these coil conductors define a helical coil.

One end of the coil is connected to an internal terminal electrode 21U via an interlayer connection conductor 26U. Similarly, the other end of the coil is connected to an internal terminal electrode 22U via an interlayer connection conductor 26U. Mounting electrodes 21L and 22L are provided on the lower surface of the lowermost substrate layer. The mounting electrodes 21L and 22L are connected to the internal terminal electrodes 21U and 22U via interlayer connection conductors 26L. The mounting electrodes 21L and 22L are an example of a "terminal electrode" according to a preferred embodiment of the present invention.

A coil antenna connection portion 31E and a conductor pattern 31 extended from the coil antenna connection portion 31E are provided on the upper surface of the board. The coil antenna connection portion 31E is an example of a pad electrode according to a preferred embodiment of the present invention.

In the antenna device 107 shown in FIG. 14A, the coil conductors of the coil antenna 2 are a right-turning helical coil as seen from the direction of a winding axis of the coil conductors (as seen in a −Y-axis direction from the mounting electrode 22L). Therefore, the extending direction from the coil conductor to the mounting electrode 21L (terminal electrode) is an X-axis direction in the drawing. In addition, the extending direction from the coil antenna connection portion (pad electrode) 31E to the conductor pattern 31 is the X-axis direction in the drawing. The conductor pattern 31 is an example of a wiring conductor according to a preferred embodiment of the present invention.

In the comparative example shown in FIG. 14B, the extending direction from the coil antenna connection portion (pad electrode) 31E to the conductor pattern 31 is a −X-axis direction in the drawing. The structure of the coil antenna 2 is the same as that of the coil antenna 2 shown in FIG. 14A.

When the extending direction from the coil conductor to the mounting electrode 21L (terminal electrode) is opposite to the extending direction from the coil antenna connection portion (pad electrode) 31E to the conductor pattern 31 as in the antenna device of the comparative example shown in FIG. 14B, a coil current does not flow through the mounting electrode (terminal electrode) 21L and the internal terminal electrode 21U, and the mounting electrode (terminal electrode) 21L and the internal terminal electrode 21U do not define and function as a portion of the coil.

On the other hand, when the extending direction from the coil conductor to the mounting electrode 21L (terminal electrode) and the extending direction from the coil antenna connection portion (pad electrode) 31E to the conductor pattern 31 coincide with each other (the X-axis direction) as shown in FIG. 14A, the mounting electrode 21L (terminal electrode) defines and functions as a portion of the coil, so that it is possible to provide an antenna device including a coil antenna with a predetermined inductance while using a smaller-sized coil antenna.

In the above-described example, operation of the mounting electrode 21L and the coil antenna connection portion 31E of the coil antenna 2 has been described. However, operation of the mounting electrode 22L of the coil antenna 2 and a coil antenna connection portion (not shown) thereof is the same. That is, the conductor pattern extending from the coil antenna connection portion to which the mounting electrode 22L of the coil antenna 2 is connected, preferably extends in the −X-axis direction.

Figure 15A:
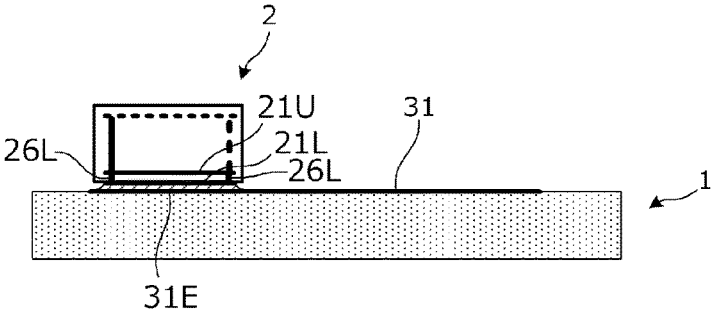
FIG. 15A is a cross-sectional view on a plane perpendicular to a coil axis, showing a relationship between an internal terminal electrode and a mounting electrode of the antenna device 107 according to the seventh preferred embodiment.
Figure 15B:
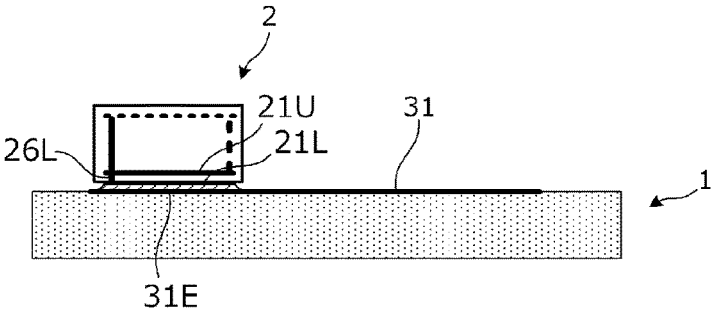
FIGS. 15B and 15C are each a cross-sectional view on a plane perpendicular to a coil axis, showing a relationship between an internal terminal electrode and a mounting electrode of another antenna device according to the seventh preferred embodiment of the present invention.
Figure 15C:
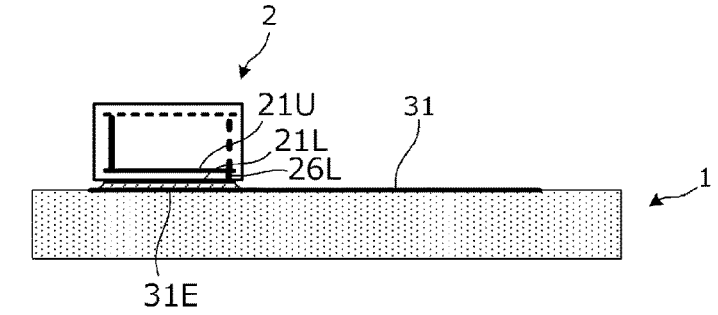

In the present preferred embodiment, an end portion of the coil conductor is not connected directly to an external mounting electrode (21L, etc.), and an internal terminal electrode (21U, etc.) is included in the middle thereof. FIG. 15A is a cross-sectional view on a plane perpendicular to a coil axis, showing a relationship between the internal terminal electrode and the mounting electrode of the antenna device 107. FIGS. 15B and 15C are each a cross-sectional view on the plane perpendicular to the coil axis, showing a relationship between an internal terminal electrode and a mounting electrode of another antenna device according to the present preferred embodiment.

In the example shown in FIG. 15A, the internal terminal electrode 21U and the mounting electrode 21L are connected to each other via the interlayer connection conductors 26L at both the rear side and the front side in the extending direction from the coil antenna connection portion 31E to the conductor pattern 31. In the example shown in FIG. 15B, the internal terminal electrode 21U and the mounting electrode 21L are connected to each other via an interlayer connection conductor 26L at the rear side in the extending direction from the coil antenna connection portion 31E to the conductor pattern 31. In the example shown in FIG. 15C, the internal terminal electrode 21U and the mounting electrode 21L are connected to each other via an interlayer connection conductor 26L at the front side in the extending direction from the coil antenna connection portion 31E to the conductor pattern 31.

In the example shown in FIG. 15A, a coil current flows through the mounting electrode 21L and the internal terminal electrode 21U, and the mounting electrode 21L and the internal terminal electrode 21U define and function as a portion of the coil antenna. In the example shown in FIG. 15B, a coil current flows through the mounting electrode 21L, and the mounting electrode 21L defines and functions as a portion of the coil antenna. In addition, in the example shown in FIG. 15C, a coil current does not flow through the mounting electrode 21L, but a coil current flows through the internal terminal electrode 21U. Therefore, the internal terminal electrode 21U defines and functions as a portion of the coil antenna.

As described above, even when the internal terminal electrode and the mounting electrode are interlayer-connected to each other at any position, if the extending direction from the coil antenna connection portion (pad electrode) to the conductor pattern (wiring conductor) is the above-described direction, at least either the mounting electrode 21L or the internal terminal electrode 21U defines and functions as a portion of the coil antenna.

Figure 16:
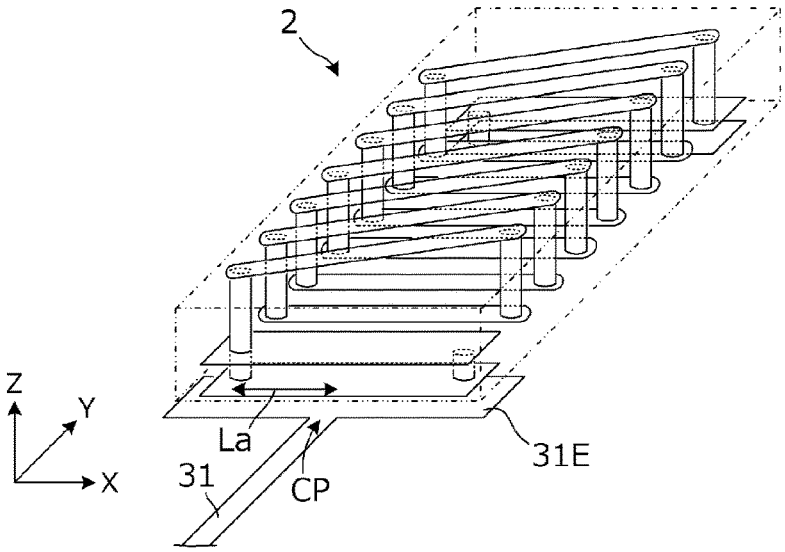
FIG. 16 is a perspective view of a main portion of another antenna device of the seventh preferred embodiment of the present invention.

FIG. 16 is a perspective view of a main portion of another antenna device of the present preferred embodiment. The conductor pattern 31 is extended from the center of the coil antenna connection portion (pad electrode) 31E in the −Y-axis direction in the drawing. The structure of the coil antenna 2 is the same as that of the coil antenna 2 shown in FIG. 14A. In this example, of the mounting electrode 21L and the internal terminal electrode 21U, portions having a length indicated by La define and function as a portion of the coil antenna.

Figure 17:
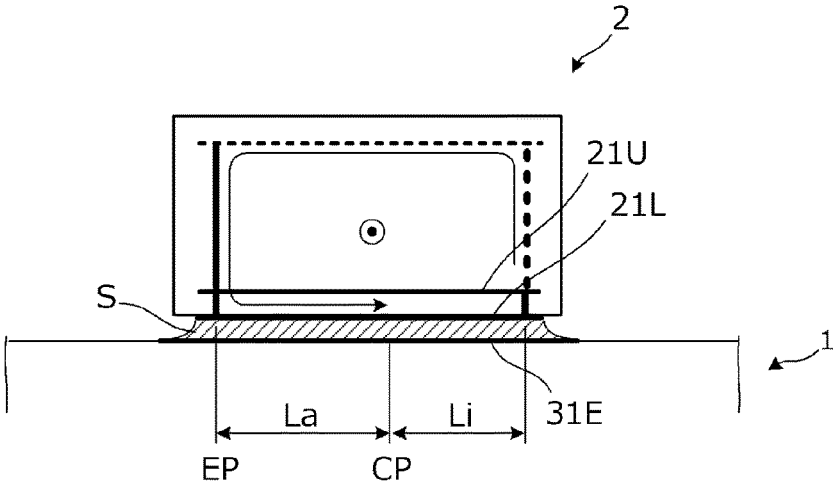
FIG. 17 is a diagram showing operation, as a portion of a coil antenna, of a mounting electrode 21L and an internal terminal electrode 21U in a structure in which a conductor pattern is extended from the middle of a coil antenna connection portion.

FIG. 17 is a diagram showing operation, as a portion of the coil antenna, of the mounting electrode 21L and the internal terminal electrode 21U in a structure in which the conductor pattern is extended from the middle of the coil antenna connection portion as shown in FIG. 16.

The mounting electrode 21L of the coil antenna 2 is soldered to the coil antenna connection portion 31E by solder S. Thus, the coil antenna 2 is surface-mounted on the board 1.

In FIG. 17, the position at which the conductor pattern (31 in FIG. 16) is extended from the coil antenna connection portion 31E is represented by CP. At the connection position CP of the conductor pattern (wiring conductor) 31 to the coil antenna connection portion (pad electrode) 31E, a coil current flows through length portions La of the internal terminal electrode 21U and the mounting electrode 21L from an end portion EP to CP as seen from the direction of the winding axis of the coil conductor (as seen in the direction from the sheet of FIG. 17 to the near side). That is, the length portions La of the internal terminal electrode 21U and the mounting electrode 21L from the end portion EP to the connection position CP of the conductor pattern (wiring conductor) 31 define and function as a portion of the coil antenna. Therefore, regarding the position at which the conductor pattern 31 is extended from the coil antenna connection portion 31E, the longer the La is, the more effective to enhance the inductance of the coil antenna it is.

Eighth Preferred Embodiment

An eighth preferred embodiment of the present invention shows an example of an electronic apparatus.

Figure 18:
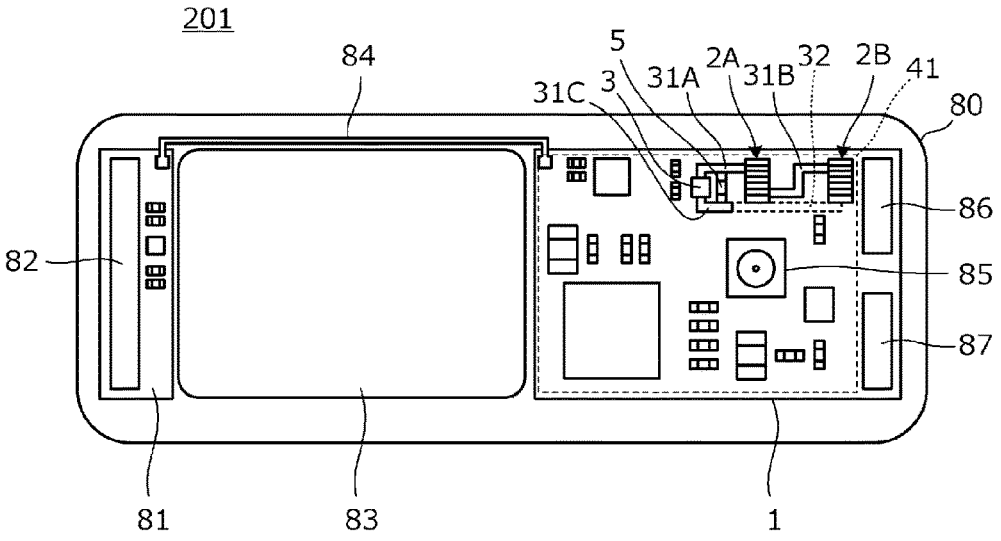
FIG. 18 is a plan view showing the internal structure of a housing of an electronic apparatus 201 according to an eighth preferred embodiment of the present invention.

FIG. 18 is a plan view showing the internal structure of a housing of an electronic apparatus 201 according to the eighth preferred embodiment. Boards 1 and 81, a battery pack 83, etc. are housed within a housing 80. Upper conductor patterns 31A, 31B, and 31C and a lower conductor pattern 32 are provided on the board 1. In addition, coil antennas 2A and 2B, a RFIC 3, and a resonance capacitor 5 are mounted on the board 1.

A camera module 85, UHF-band antennas 86 and 87, etc. are also mounted on the board 1. In addition, a UHF-band antenna 82, etc. are mounted on the board 81. The board 1 and the board 81 are connected to each other via a cable 84.

The capacitance components included in the coil antennas 2A and 2B, the upper conductor patterns 31A, 31B, and 31C, the lower conductor pattern 32, and the RFIC 3, and the capacitance of the capacitor 5 define an LC resonant circuit. The capacitor 5 shown in the present preferred embodiment is a capacitor that adjusts the resonant frequency of the LC resonant circuit, and is not essential.

The configurations of the coil antennas 2A and 2B are the same as in the antenna device 101 shown in the first preferred embodiment, etc. The basic configuration of an auxiliary loop conductor including the upper conductor patterns 31A, 31B, and 31C and the lower conductor pattern 32 is the same as that of the auxiliary loop conductor of the antenna device 102 shown in the second preferred embodiment. The auxiliary loop conductor generates a magnetic flux that is in phase with those of the coil antennas 2A and 2B as seen from the direction of the winding axis of the coil conductors of each of the coil antennas 2A and 2B.

A first conductive member 41 is provided below a region where the coil antennas 2A and 2B and the auxiliary loop conductor are located. The first conductive member 41 is a shielding metal plate provided at the back surface of a display panel.

Because of this configuration, among the magnetic fields generated in the coil antennas 2A and 2B, a magnetic flux that tries to extend around to the first conductive member 41 is forced to extend in a direction along the first conductive member 41. That is, operation in which magnetic field generation by the coil antennas 2A and 2B is hindered by the first conductive member 41 is significantly reduced or prevented. Accordingly, it is possible to reduce or prevent a decrease in communication distance even in the case where the coil antennas 2A and 2B are disposed at the back side of the display panel.

In the present preferred embodiment, the first conductive member 41 is a metal plate of the display panel. However, another shielding conductive member, a ground conductor pattern provided on a board, a battery pack, or the like may be a first conductive member.

In each of the above preferred embodiments, operation has been described in which a current flows from the RFIC 3 through the coil antenna (2, 2A, 2B) and the auxiliary loop conductor and a magnetic field of a transmission signal is generated from the coil antenna (2, 2A, 2B) and the auxiliary loop conductor. However, when a magnetic flux from a communication partner antenna links to the coil antenna (2, 2A, 2B, etc.) and the auxiliary loop conductor, a current corresponding to a received signal flows through the coil antenna (2, 2A, 2B) and the auxiliary loop conductor because of the reversibility of the antenna.

Antenna devices including two coil antennas has been described in some of the preferred embodiments described above. However, the present invention is similarly applicable to the case where an antenna device includes three or more coil antennas.

Finally, the description of the above preferred embodiments is illustrative in all respects and not limiting. A person skilled in the art can make modifications and changes as appropriate. For example, the components shown in the different preferred embodiments may be partially replaced or combined. The scope of the present invention is determined by the claims, not by the above preferred embodiments. Furthermore, all changes that come within the meaning and range of equivalents of the claims are intended to be embraced in the scope of the present invention.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An antenna device comprising:

an insulating substrate including a principal surface; and a coil antenna disposed on the substrate and including a coil conductor; wherein the coil conductor includes a winding axis in a direction parallel or substantially parallel to the principal surface of the substrate;

the coil conductor is wound by one full turn or more when seen from the direction of the winding axis of the coil conductor; and an auxiliary loop conductor that is connected to the coil conductor and generates a magnetic flux that is in phase with that of the coil antenna as seen from a direction of the winding axis of the coil conductor is provided in or on the substrate.

2. The antenna device according to claim 1, wherein the coil antenna includes a first coil antenna and a second coil antenna;

each of the first coil antenna and the second coil antenna includes a winding axis in the direction parallel or substantially parallel to the principal surface of the substrate, the winding axes of the first coil antenna and the second coil antenna are parallel or substantially parallel to each other, and the first coil antenna and the second coil antenna are connected to each other so as to generate magnetic fields that are in phase with each other in the parallel direction; and the auxiliary loop conductor is disposed in a range from the first coil antenna to the second coil antenna as seen from the direction of the winding axis of the coil conductor.

3. The antenna device according to claim 1, wherein a surface of the substrate on which the coil antenna is disposed is a surface opposite to a surface facing a first conductive member; and the auxiliary loop conductor extends between the coil antenna and the first conductive member as seen from the direction of the winding axis of the coil conductor.

4. The antenna device according to claim 1, wherein a second conductive member is provided on the substrate and in at least a portion of a region surrounded by the auxiliary loop conductor in a plan view of the substrate.

5. The antenna device according to claim 1, wherein the coil antenna includes a terminal electrode conducted to the coil conductor and extending from the coil conductor along the coil conductor as seen from the direction of the winding axis of the coil conductor;

the substrate includes a pad electrode to which the terminal electrode is connected, and a wiring conductor extended from the pad electrode; and an extending direction from the coil conductor to the terminal electrode and an extending direction from the pad electrode to the wiring conductor are the same.

6. The antenna device according to claim 5, wherein a connection position of the wiring conductor to the pad electrode is spaced away from a first end that is a connection position of the terminal electrode to the coil conductor, in a direction toward a second end of the terminal electrode as seen from the direction of the winding axis of the coil conductor.

7. The antenna device according to claim 1, further comprising a radio frequency integrated circuit connected to the coil antenna.

8. The antenna device according to claim 1, wherein the coil antenna includes a first coil antenna and a second coil antenna, and the magnetic flux generated in the auxiliary loop conductor is in phase with magnetic fluxes generated in the first coil antenna and the second coil antenna.

9. The antenna device according to claim 8, wherein each of the first coil antenna and the second coil antenna includes coil conductors wound in a helical shape and mounting electrodes.

10. The antenna device according to claim 1, wherein the auxiliary loop conductor includes a plurality of conductor patterns including a first group of conductor patterns that overlap each other and a second group of conductor patterns that do not overlap each other in a plan view.

11. The antenna device according to claim 1, wherein the auxiliary loop conductor includes a plurality of conductor patterns including at least one conductor pattern on an upper surface of the substrate and at least one conductor patterns on a lower surface of the substrate.

12. The antenna device according to claim 11, wherein the substrate includes at least one interlayer connection conductor that connects the at least one conductor pattern on the upper surface of the substrate and the at least one conductor patterns on the lower surface of the substrate.

13. The antenna device according to claim 11, wherein the coil antenna includes a first coil antenna and a second coil antenna connected in parallel to the at least one conductor pattern on the upper surface of the substrate and the at least one conductor patterns on the lower surface of the substrate.

14. The antenna device according to claim 1, wherein the coil antenna is the only coil antenna in the antenna device.

15. The antenna device according to claim 1, wherein the auxiliary loop conductor includes a plurality of conductor patterns and a plurality of interlayer connection conductors.

16. The antenna device according to claim 1, wherein the coil antenna includes coil conductors that define a right-turning helical coil.

17. An electronic apparatus comprising:

the antenna device according to claim 1; and a power supply circuit connected to the antenna device.

18. The electronic apparatus according to claim 17, further comprising a camera module, a radio frequency integrated circuit and a capacitor mounted on the substrate.

19. The electronic apparatus according to claim 17, further comprising an LC resonant circuit.

20. The electronic apparatus according to claim 17, further comprising UHF band antennas mounted on the substrate.

* * * * *